US007014493B1

(12) United States Patent
Battard

(10) Patent No.: US 7,014,493 B1
(45) Date of Patent: Mar. 21, 2006

(54) RETAINING SOCKET FOR ELECTRICAL OUTLETS

(76) Inventor: Derek J. Battard, 6450 Avenue A, New Orleans, LA (US) 70124

( * ) Notice: Subject to any disclaimer, the term of this patent is extended or adjusted under 35 U.S.C. 154(b) by 40 days.

(21) Appl. No.: 10/887,199

(22) Filed: Jul. 8, 2004

Related U.S. Application Data

(63) Continuation-in-part of application No. 10/617,282, filed on Jul. 10, 2003, now abandoned.

(51) Int. Cl.
*H01R 13/64* (2006.01)

(52) U.S. Cl. ..... 439/373; 439/371

(58) Field of Classification Search ..... 439/357, 439/369, 370, 371, 372, 373, 953
See application file for complete search history.

(56) References Cited

U.S. PATENT DOCUMENTS

| | | | | |
|---|---|---|---|---|
| 2,659,059 A | | 11/1953 | Johnson | |
| 4,045,108 A | | 8/1977 | Olsen | |
| 4,105,274 A | | 8/1978 | Casey | |
| D325,564 S | | 4/1992 | Lemke | |
| 5,348,495 A | | 9/1994 | Kasden | |
| 5,575,677 A | | 11/1996 | Buckner et al. | |
| 5,655,924 A | | 8/1997 | Cross et al. | |
| 5,934,919 A | * | 8/1999 | Cross et al. | 439/136 |
| 5,989,052 A | * | 11/1999 | Fields et al. | 439/373 |
| 6,095,846 A | | 8/2000 | Becerra | |
| 6,769,930 B1 | * | 8/2004 | McDevitt, Jr. | 439/373 |
| 6,939,161 B1 | * | 9/2005 | Yi et al. | 439/373 |
| 2005/0202709 A1 | * | 9/2005 | Campbell et al. | 439/373 |

* cited by examiner

*Primary Examiner*—Thanh-Tam Le
(74) *Attorney, Agent, or Firm*—Garvey,Smith,Nehrbass & North, L.L.C.; Brett A. North

(57) ABSTRACT

A retaining clip for retaining a plug carried by a cord in a socket of an electrical receptacle which includes, in one embodiment, a plate mountable to the receptacle, a clip mountable on the plate and resisting efforts to pull out an electrical plug plugged into the socket.

13 Claims, 4 Drawing Sheets

RETAINING SOCKET FOR ELECTRICAL OUTLETS

CROSS-REFERENCE TO RELATED APPLICATIONS

This is a continuation-in-part of U.S. patent application Ser. No. 10/617,282, filed Jul. 10, 2003 now abandoned.

U.S. patent application Ser. No. 10/617,282, filed Jul. 10, 2003, is incorporated herein by reference.

Priority is claimed to U.S. patent application Ser. No. 10/617,282, filed Jul. 10, 2003.

STATEMENT REGARDING FEDERALLY SPONSORED RESEARCH OR DEVELOPMENT

Not applicable

REFERENCE TO A "MICROFICHE APPENDIX"

Not applicable

BACKGROUND

1. Field

The present invention relates to a retaining socket for an electrical outlet. More particularly, the present invention relates to a retaining socket which can resist the pulling out of an electrical plug regardless of which direction tension is placed on an electrical cord.

2. General Background

A plug for an electrical appliance, such as a vacuum cleaner, can become loosened or pulled from its outlet when the appliance is attempted to be moved to a work area located away from the outlet. Various devices have attempted to address this issue, but each have their own disadvantages. For example, some do not satisfactory protect against tensions from all directions relative to the outlet. Others are permanently attached to an outlet and present an obstacle when not in use. Others require extensive modifications to the outlet and/or plug or require numerous additional components attached in a complex fashion to the outlet and/or plug.

The need exists for a plug retainer which resists pulling out of a plug from all directions, which is low cost to make, and easy to attach and detach from the outlet.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a retaining socket which can resist the pulling out of an electrical cord.

It is an object to provide a system for retaining an electrical plug in the socket of an electrical outlet.

It is another object to provide a retaining system which is readily attachable to and removable from the plug and the outlet.

It is a further object to provide a retaining system which does not require elaborate modification to the plug or the outlet.

It is an additional object to provide a retaining system which can be stored out of the way when not in use.

It is yet another object to provide a retaining system which is inexpensive to manufacture and is composed of a minimal number of cooperating parts.

These and other objects of the present invention, as well as the advantages thereof over existing prior art forms, which will become apparent from the description to follow, are accomplished by the improvements hereinafter described and claimed.

In general, a system for retaining a plug in a socket of an electrical receptacle includes a plate mounted to the receptacle in such a way that the socket remains exposed. In one embodiment the plate carries opposed lugs which detachably connect with a retaining clip and the retaining clip can cradle the plug when mounted on the lugs. In another embodiment the plate includes opposed openings which detachably connect with a retaining clip and the retaining clip can cradle the plug when mounted in the openings.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

PREFERRED EMBODIMENTS FOR CARRYING OUT THE INVENTION

Figure 1:
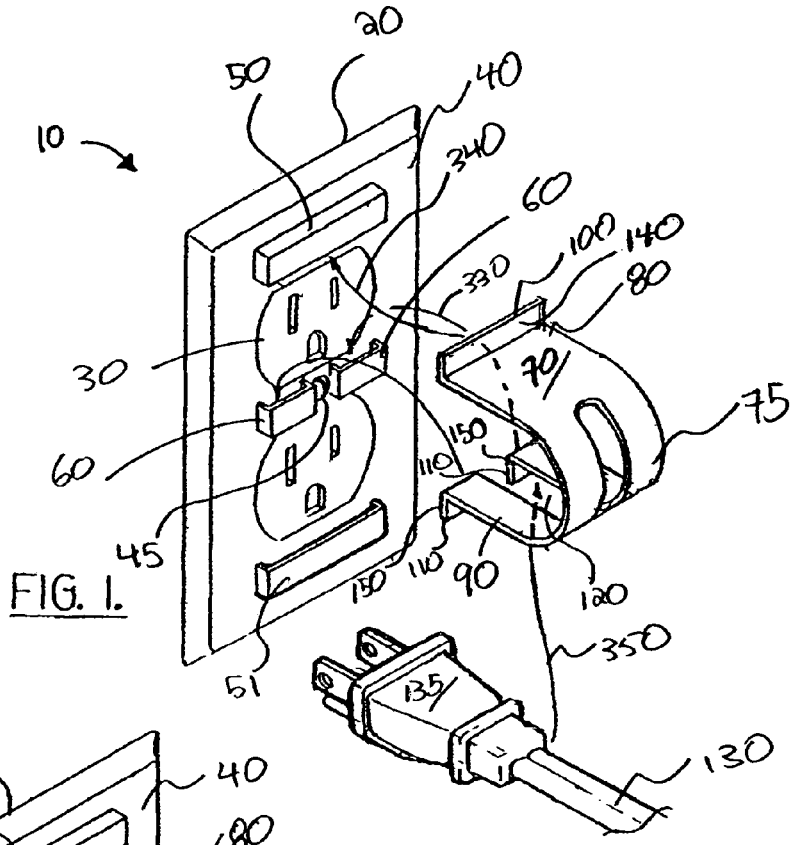
FIG. 1 is an exploded perspective view of a flanged retainer clip, outlet plate, and electrical plug.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Electrical plug retainer is generally indicated reference numeral 10 in the drawings and is adapted to retain plug 135, carried by cord 130, in a conventional wall receptacle 20. Electrical plug retainer 10, as illustrated in FIGS. 1–6, generally includes a modified receptacle plate (generally indicated by reference numeral 40) and clip (generally indicated by reference numeral 70) having a slot 120 which slot allows passage of cord 130, but not plug 135. When attached to face plate 40, clip 70 retains plug 135 in socket 30. Clip 70 retains plug 135 in socket 30 notwithstanding pulling forces being applied to cord 135 in various directions.

Face plate 40 includes conventional openings exposing sockets 30 of receptacle 20 when plate 40 is attached to receptacle 20, such as by screw 45. Face plate 40 can include at least one set of opposed lugs 50, 60 positioned on opposing sides of socket 30 of electrical outlet 20 (located behind plate 40). In one embodiment, plate 40 can include a second set of opposed lugs 51,60 on opposing sides of socket 35. Furthermore, in another embodiment opposed lugs 50,60 can be vertically oriented, and optionally extend the length of sockets 30,35. Lugs 50,60 may be constructed of metal, plastic, injection molded plastic, wood, or any other material which is substantially strong and durable. They may be attached to plate 40 using any conventional means such as adhesives, welding, or mechanical means. Alternatively, lugs 50,60 may be integrally molded, formed, or fabricated with plate 40.

Clip 70 may be constructed of metal, plastic, injection molded plastic, wood, or any other material which is substantially strong and durable. Preferably clip 70 is generally U-shaped in configuration and can include base 75, first arm 80, and second arm 90. First and second arms 80,90 can include tips 100,110. Second arm 90 can be provided with slot 120 allowing cord 130 to freely pass and/or slide therethrough but resisting movement of plug 135. Clip 70 can be rounded, square shaped, V-shaped or configured otherwise to allow adequate flexing of arms 80,90.

FIG. 1 is an exploded perspective view of a flanged retainer clip 70, outlet plate 40, and electrical plug 135. Clip 70 can include first and second arms 80,90 having first and second tips 100,110. First and second tips 100,110 can be in the form of flanges 140,150. Slot 120 can be formed in second arm 90 and extending through tip 110 and be of sufficient size to allow access of cord 130, but restrict movement of plug 135.

Slot 120 can extend through second arm 90, base 75, and partially into first arm 80. In one embodiment slot 120 can extend completely through first arm 80 and tip 100 effectively creating dual sets of first and second arms 80,90. However, such embodiment would not have as much structural support and may be prone to snapping out of lugs 50,60 when tension is placed on cord 130.

Second arm 90 is shown including slot 120 and having two portions of tip 110 and two portions of flange 150. Such dual portions interconnect with the dual portions of lug 60 and accommodate screw 45 of faceplate 40. Tip 100 of first arm 80 forms flange 140 and interconnects with lug 50.

Plug 135 can placed inside of clip 70 as shown by arrow 350. Cord 130 slides through slot 120 and clip 70 cradles plug 135.

Plug 135 can first be inserted into socket 30. Clip 70 can next be placed over plug 135 by sliding cord 130 into slot 120. Clip 70 can next be mounted to plate 40 as shown by arrows 330,340. First and second arms 80,90 are squeezed towards each other and then slid into first and second lugs 50,60. First and second arms 80,90 are then allowed to expand so that tips 100,110 comprising flanges 140,150 will interlock with first and second lugs 50,60. Clip 70 will then cradle plug 135 as shown in FIG. 2.

Figure 2:
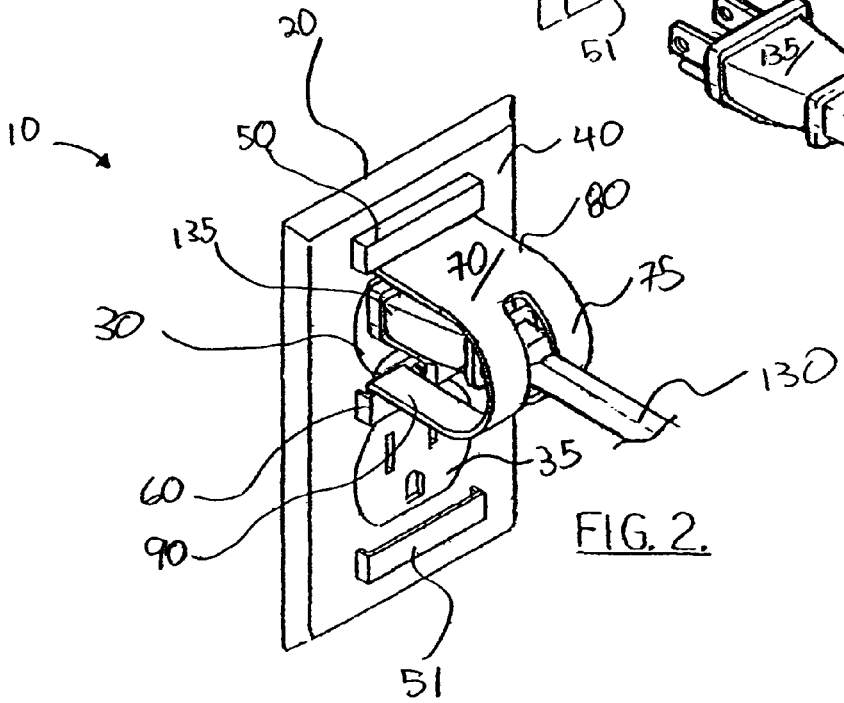
FIG. 2 is a perspective view of the retainer clip in FIG. 1 showing the clip attached to the outlet plate and retaining an electrical plug.

FIG. 2 is a perspective view of the retainer clip 70 in FIG. 1 showing clip 70 attached to plate 40 and retaining electrical plug 135. Thus mounted clip 70 will resist tension in plug 135 created by a pulling on cord 135 and resist a break the connection between plug 135 and socket 35. The tension will be transferred to first and second arms 80,90, tips 100,110, and then by first and second lugs 50,60.

To remove clip 70 first and second arms 80,90 are squeezed towards each other and then tips 100,110 comprising flanges 140,150 can be slid out of first and second lugs 50,60. In this manner tips 100,100 can be detachably connectable to first and second lugs 50,60. Clip 70 may be left in position on plate 40, as desired, or may be readily removed and stored away until a subsequent use.

In one embodiment first lug 51 is attached to plate 40 on an opposing side of socket 35. Lug 60 can also serve as an opposing lug for lug 51, or alternatively a second lug could be mounted on plate 40. A second clip 70 can be provided allowing two retaining systems for a single electrical outlet. The operation of the second clip 70 would be substantially the same as described above.

Figure 3:
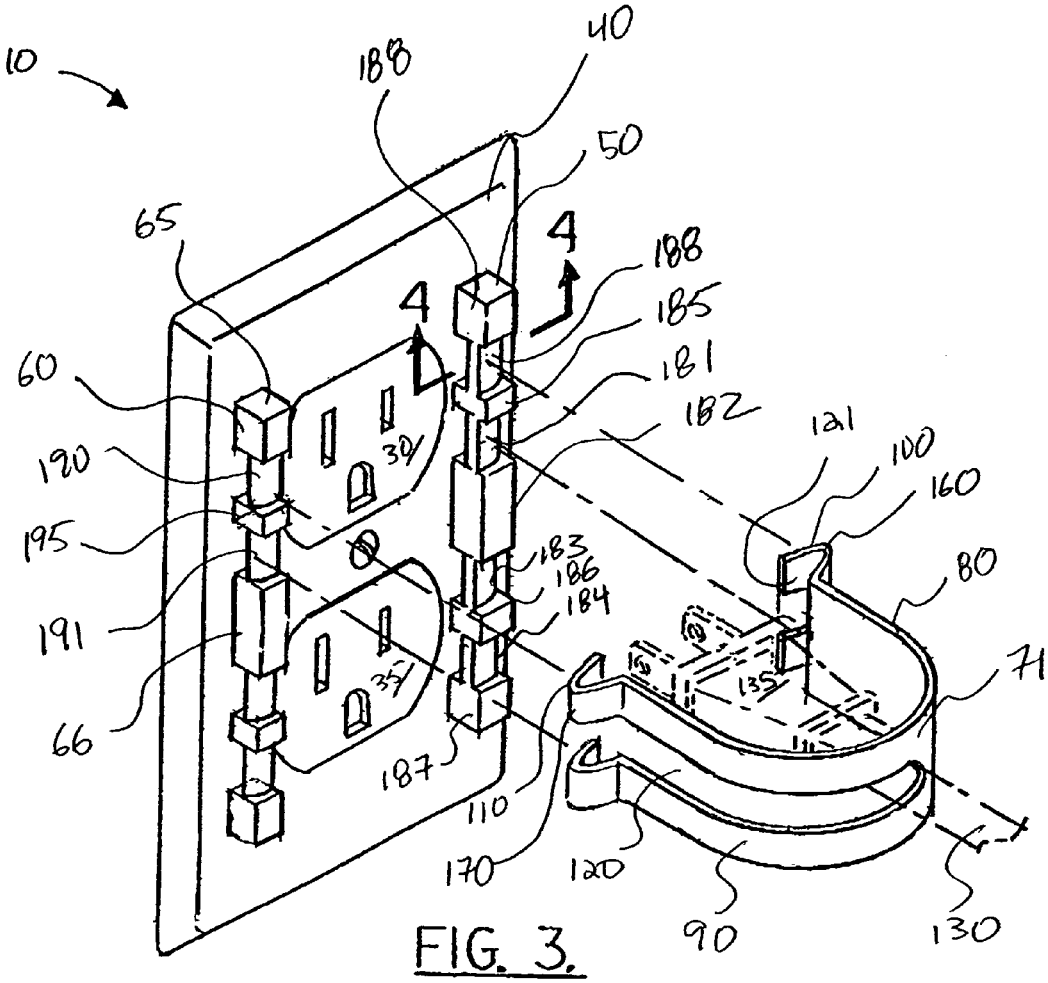
FIG. 3 is an exploded perspective view of a ribbed retainer clip and outlet plate.

FIG. 3 is an exploded perspective view of a ribbed retainer clip 71 and outlet plate 40. In the embodiment shown clip 71 is generally U-shaped and includes first and second arms 80,90, tips 100,110, and slot 120. Tips 100,110 can comprise ribs 160,170. Ribs 160, 170 can be shaped in the form of a parabola or curved to facilitate attaching and detaching from lugs 50,60. Alternatively, ribs 160,170 can be flanged similar to the embodiment shown in FIGS. 1 and 2, but with the flanges pointing inwardly instead of outwardly. Also alternatively, ribs 160,170 can be shaped in the form of a semicircle or trapezoid (similar to that shown in FIG. 5), shaped in the form of a rectangle, or other shape which allows a detachable connection to lugs 50,60.

Lugs 50,60 are shown vertically oriented and extending the length of sockets 30,35. Alternatively, lugs 50, 60 can be horizontally oriented (similar to FIGS. 1–2). Also alternatively, lugs 50,60 can not extend the length of sockets 30,35, but be confined to one socket such as 30 or 35. For example, there may be two sets of lugs 50,60, respectively for sockets 30,35.

Figure 4:
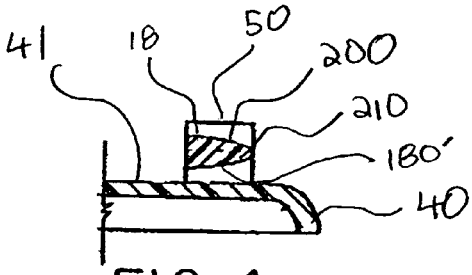
FIG. 4 is a sectional view of the lug taken along lines 4—4 of FIG. 3.

FIG. 4 is a sectional view of lug 50 taken along lines 4—4 of FIG. 3. Lug 50 can be attached to plate 40. Lug 50 can include curved portion 180 having vertex 210. Curved portion 180 can be in the shape of a parabola 200. As shown in FIG. 3, Lug 50 can include spacer 185 separating curved portions 180,181 and also base portions 188,182. Spacer 185 and base portions 188,182 facilitate structural attachment of lug 50 to plate 40. Spacer 185 is optional and is believed to provide additional structural support for lug 50 and stability for the detachable connection between clip 71 and lugs 50,60.

Lug 50 can extend the vertical distance between sockets 30,35 as shown in FIG. 3 and can include additional spacer 186, base 187, and curved portions 183,184. Alternatively, a separate lug can be provided not connected to lug 50. Construction of lug 60 can be substantially the same as lug 50.

Connection of clip 71 to plate 40 is similar to that described for clip 70. However, first and second arms 80,90 are moved away from each other for attachment to lugs 50,60. To facilitate this outward movement of arms 50,70, curved portions 180,181 and 190,191 are provided. When tips 100,110 touch curved portions 180,181 and 190,191, tips tend to move outward allowing clip 71 to be pushed onto lugs 50,60 and snap in place. Ribs 160,170 will grab hold of curved portions 180,181 and 190,191. Space 121 in arm 80 is provided to work around spacer 185, however, if spacers 185 and/or 195 are not used space 121 can be eliminated.

Curved portions 180,181 and 190,191 can also facilitate removal of clip 71 from lugs 50,60. As clip 71 is pulled from plate 40 the curved portions of curved portions 180,181 and 190,191 located adjacent the face 41 of plate 40 and interacting with ribs 160,170 will tend to cause arms 80,90 to move outwardly thus allowing clip 71 to snap off. However, such a design may also tend to allow clip 71 to pop off when tension is applied to cord 130. Alternatively, curved portions 180,181 and 190,191 can be in the shape of half parabolas and ribs 160,170 can be in the shape of rectangles and/or merely flanged. For example, interior face 180' can be flat and parallel to face 41 of plate 40. In such alternative constructions, tension on cord 130 would not tend to push out arms 80,90, however, arms 80,90 would be pulled apart to remove clip 71 from lugs 50,60.

Figure 5:
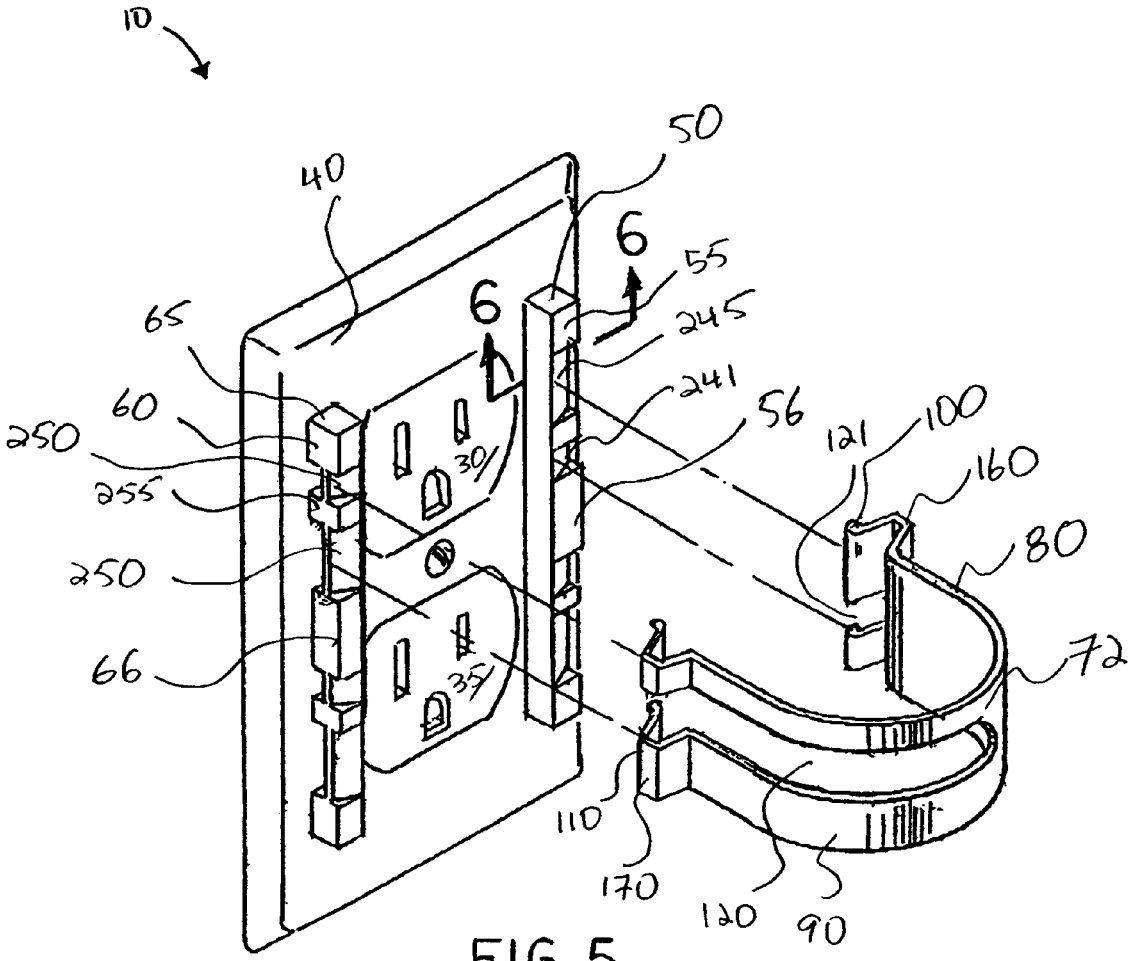
FIG. 5 is an exploded perspective view of a ribbed retainer clip and outlet plate.

FIG. 5 is an exploded perspective view of a ribbed retainer clip 72 and plate 40. Its construction is similar to that of clip 71. Arms 80,90 can include tips 100,110 which comprise ribs 160,170. Ribs 160,170 can be trapezoidal in shape or other shapes such as those described for FIG. 3. Additionally slot 120 can and gap 121 can be offset from the longitudinal center lines of arms 80,90. Such offsetting is believed to give clip 72 added stability against tensions in cord 130 which are not perpendicular to the face of plate 40 (such as by upward or downward pulling on cord 135). Additionally, offsetting helps accommodate different types of plugs 135 and sockets 30,35 (e.g., three pronged versus two pronged). Because slot 120 and space 121 are offset spacers 245,255 can be respectively positioned to accommodate such offsetting. As with clip 71, spacers 245,255 can be omitted, but when included should provide added stability of clip 72 when attached to lugs 50,60.

Figure 6:
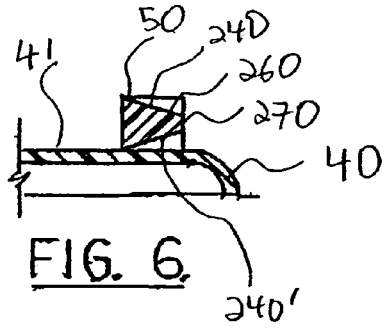
FIG. 6 is a sectional view of the lug taken along lines 6—6 of FIG. 5.

FIG. 6 is a sectional view of lug 50 taken along lines 6—6 of FIG. 5. Lug 50 can include angled portion 240 having top 270. Angled portion 240 can be in the shape of a trapezoid 270. Similar to the discussion of FIGS. 3–4, the face 240' of angled portion 240 can be parallel to face 41 of plate 40 to resist tension in cord 130 from pulling out clip 72. Ribs 160,170 can be of various additional shapes such as parabolic, curvilinear, rectangular, and flanged.

Figure 7:
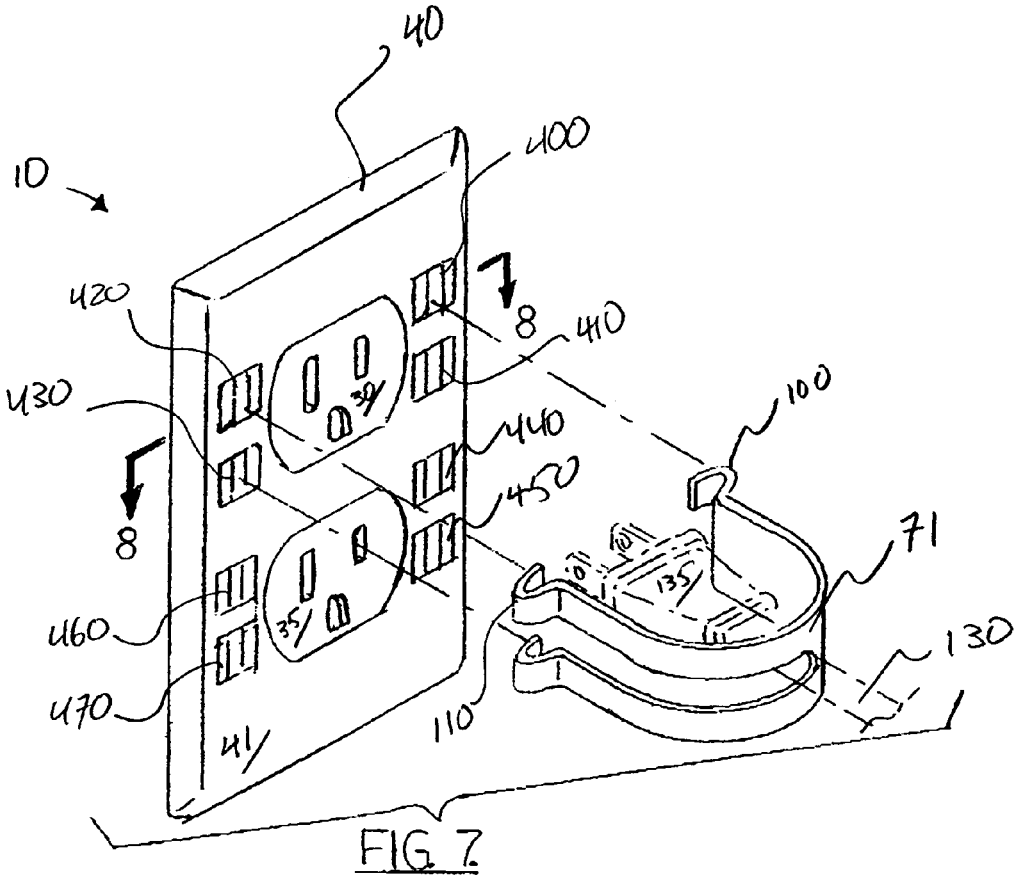
FIG. 7 is an exploded view of a retaining clip which can be connected to a plate having a plurality of openings.
Figure 8:
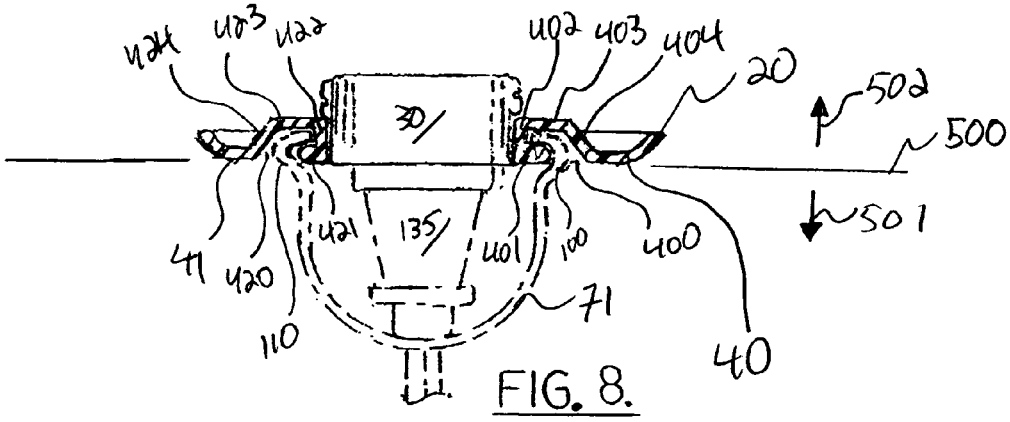
FIG. 8 is a sectional view taken along lines 8—8 of FIG. 7.

FIG. 7 is an exploded view of a retaining clip 71 which can be connected to plate 41 having a plurality of openings 400,410,420,430 around socket 30. A second plurality of openings 440,450,460,470 can be included around socket 35. FIG. 8 is a sectional view taken along lines 8—8 of FIG. 7 showing plug 135 being retained in socket 30 by retainer 71. Line 500 divides the front (shown by arrow 501) and rear (shown by arrow 502) of face 41 for plate 40.

Retainer 71 can comprise tips 100,110. As discussed in the other embodiments tips 100,110 can be of various shapes such as curved, semicircular, parabolic, trapezoidal, square, or rectangular. Alternatively tips 100,110 can be flanged either inwardly or outwardly. As shown in FIG. 8 tips 100, 110 can detachably connect to tabs 401,421.

It is preferred to have all openings enclosed thereby preventing access to any electrical connections behind plate 40. This will prevent accidental shocks such as by small children playing with wires or metal objects around plate 41. Opening 400 can be closed in by tab 401, side 402, backing 403, and side 404. Side 404 can be angled or curved assisting in inserting and removing tip 100. Opening 420 can be closed in by tab 421, side 422, backing 423, and side 424. Side 424 can be angled or curved assisting in inserting and removing tip 110.

Openings 400 and 410 are shown separated but can be combined as a single opening. Similarly openings 420 and 430 can be combined. Alternatively, openings 400,410,440, and 450 can be combined as a single opening (and openings 420,430,460, and 470 can be combined as a single opening).

In an alternative embodiment tips 100,110 could be flanged outward (instead of inward as shown). Flanging tips outward would allow clip 71 to be connected or removed by squeezing instead of expanding (expanding is required by tips facing inwardly as shown in FIGS. 7 and 8).

It is preferred that plate 40 of FIG. 7 with all openings and enclosures are constructed by integrally molding the entire plate 40 and all components comprising the plurality of openings and enclosing items. For example plate 40 could be an injection molded polymer and can also include various strengthening additives to the polymer to account for the increased loads on plate 40 and especially tabs 401,421. Alternatively, individual enclosure units 510 can be connected behind one or more of the plurality of openings.

The following is a list of reference numerals used in the application:

LIST OF REFERENCE NUMERALS

| (Reference No.) | (Description) |
|---|---|
| 10 | electrical plug retainer |
| 20 | electrical receptacle |
| 30 | socket |
| 35 | socket |
| 40 | plate |
| 41 | face of plate 40 |
| 45 | screw |
| 50 | first lug |
| 51 | first lug |
| 55 | upper cap |
| 56 | lower cap |
| 60 | second lug |
| 65 | upper cap |
| 66 | lower cap |
| 70 | clip |
| 71 | clip |
| 72 | clip |
| 75 | base |
| 80 | first arm |
| 90 | second arm |
| 100 | tip |
| 110 | tip |
| 120 | slot |
| 121 | gap |
| 130 | electrical cord |
| 135 | plug |
| 140 | flange |
| 150 | flange |
| 160 | rib |
| 170 | rib |
| 180 | curved portion |
| 180' | interface of curved portion 180 |
| 181 | curved portion |
| 182 | base |
| 183 | curved portion |
| 184 | curved portion |
| 185 | spacer |
| 186 | spacer |
| 187 | base |
| 188 | base |
| 190 | curved portion |
| 200 | parabola |
| 195 | spacer |
| 210 | vertex |
| 220 | parabola |

-continued

LIST OF REFERENCE NUMERALS

| (Reference No.) | (Description) |
|---|---|
| 230 | vertex |
| 240 | angled portion |
| 240' | interior face of angled portion 240 |
| 241 | angled portion |
| 245 | spacer |
| 250 | angled portion |
| 255 | spacer |
| 260 | trapezoid |
| 270 | top |
| 280 | trapezoid |
| 290 | top |
| 300 | U-shaped. |
| 310 | inlet |
| 320 | inlet |
| 330 | arrow |
| 340 | arrow |
| 350 | arrow |
| 400 | opening |
| 401 | tab |
| 402 | side |
| 403 | backing |
| 404 | side |
| 410 | opening |
| 420 | opening |
| 421 | tab |
| 422 | side |
| 423 | backing |
| 424 | side |
| 430 | opening |
| 440 | opening |
| 450 | opening |
| 460 | opening |
| 470 | opening |
| 500 | line |
| 501 | arrow |
| 502 | arrow |

All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

I claim:

1. An electrical plug retainer for an electrical receptacle having at least one socket, the retainer comprising (a) a plate mountable to the receptacle and allowing access to the socket, the plate having front and rear faces;

(b) a plurality of openings in the plate, at least two of the openings being located on substantially opposing sides of the socket; and (c) a clip mountable on the receptacle via the plurality of openings, the clip comprising:

(i) a first arm and a second arm, the first and second arms being on opposed sides of the clip;

(ii) the first arm comprising a tip, the tip being detachably connectable to at least one of the plurality of openings;

(iii) the second arm comprising a tip, the tip being detachably connectable to at least one of the plurality of openings;

(iv) the second arm further comprising a slot, the slot extending to the tip of the second arm and being capable of receiving an electrical cord;

(v) when mounted on the receptacle, the clip resisting efforts to pull out an electrical plug plugged into the socket; and (vi) when mounted on the receptacle, at least one of the tips at least partially penetrating the front face of the plate.

2. The retainer of claim 1, wherein there are four openings around each socket of the plate.

3. The retainer of claim 1, wherein at least one of the openings extends from the front face to the rear face of the plate.

4. The retainer of claim 1, wherein at least one of the openings includes an enclosure attached to the rear face of the plate, the enclosure restricting access to the rear of the plate.

5. The retainer of claim 4, wherein each one of the openings includes an enclosure attached to the rear face of the plate, each enclosure restricting access to the rear of the plate from its respective opening.

6. The retainer of claim 1, wherein each opening includes a tab, each tab being detachably connectable to one of the tips of the clip.

7. The retainer of claim 5, wherein each enclosure includes a first side, backing, and second side, the first and second sides being attached to the rear of the plate and the backing being attached to the first and second sides.

8. The retainer of claim 7, wherein at least one of the sides is angled in relation to the rear of the plate.

9. The retainer of claim 7, wherein at least one of the sides is curved in relation to the rear of the plate.

10. The retainer of claim 7, wherein at least one of the sides is perpendicular in relation of the rear of the plate.

11. The retainer of claim 6, wherein each tab is parallel and level with respect to the front face of the plate.

12. The retainer of claim 6, wherein at least one of the tabs is recessed with respect to the front face of the plate.

13. The retainer of claim 6, wherein at least one tab is angled with respect to the front face of the plate.

* * * * *